US006070721A

United States Patent [19]

Levitan

[11] Patent Number: 6,070,721

[45] Date of Patent: Jun. 6, 2000

[54] DISPLAY CASE FOR PHONOGRAPH ALBUM AND RECORD

[76] Inventor: Richard J. Levitan, 10704 Cloverbrooke Dr., Potomac, Md. 20854

[21] Appl. No.: 09/228,180

[22] Filed: Jan. 11, 1999

[51] Int. Cl.[7] ..... B65D 85/57

[52] U.S. Cl. ..... 206/308.1; 206/232; 206/311; 206/806; 220/481; 220/848

[58] Field of Search ..... 206/308.1, 309, 206/311, 312, 313, 232, 806; 220/326, 481, 480, 848, 845, 796; 248/213.2, 304, 311.2, 313, 339

[56] References Cited

U.S. PATENT DOCUMENTS

| | | | |
|---|---|---|---|
| D. 288,630 | 3/1987 | Haugen . | |
| 1,621,536 | 3/1927 | Handte | 248/213.2 |
| 1,634,777 | 7/1927 | Girdler | 248/213.2 |
| 3,829,132 | 8/1974 | Willieme | 206/232 |
| 4,258,488 | 3/1981 | Schienbein . | |
| 4,499,994 | 2/1985 | Rentch . | |
| 4,536,979 | 8/1985 | Parkinson . | |
| 4,578,886 | 4/1986 | Lofredo . | |
| 4,736,538 | 4/1988 | Pierce et al. . | |
| 4,895,252 | 1/1990 | Nomula et al. | 206/310 |
| 4,993,552 | 2/1991 | Bugbey et al. | 206/308.1 |
| 5,050,324 | 9/1991 | Casull . | |
| 5,101,971 | 4/1992 | Grobecker | 206/232 |
| 5,290,118 | 3/1994 | Ozeki | 206/308.1 |
| 5,477,960 | 12/1995 | Chen | 206/308.1 |
| 5,509,528 | 4/1996 | Weisburn | 206/308.1 |
| 5,513,749 | 5/1996 | Simmons | 206/308.1 |
| 5,515,967 | 5/1996 | Fitzsimmons et al. | 206/307.1 |
| 5,531,320 | 7/1996 | Uchida | 206/308.1 |
| 5,551,559 | 9/1996 | Roth et al. | 206/308.1 |
| 5,645,165 | 7/1997 | Taniyama | 206/308.1 |
| 5,775,492 | 7/1998 | Ban | 206/308.1 |
| 5,788,068 | 8/1998 | Fraser et al. | 206/308.1 |
| 5,806,694 | 9/1998 | Selmer-Pedersen | 211/40 |
| 5,890,590 | 4/1999 | Doodson | 206/308.1 |

*Primary Examiner*—Paul T. Sewell
*Assistant Examiner*—Nhan T. Lam
*Attorney, Agent, or Firm*—James L. Bean

[57] ABSTRACT

A display case for simultaneously displaying a phonograph album and record includes a shallow rectangular open topped base tray having a width to receive an album and a length to receive the album and at least a portion of a phonograph record. A support post projects from the bottom of the tray to support and position the record in the case at the end of the tray opposite the album preferably with a portion of the record inserted into an open side of the album. A hinged transparent cover is mounted on the tray to cover the album and record, and a latch is proved to releasably retain the cover in a closed position. Hanger brackets may be mounted on the back of the tray for hanging the case on a wall for displaying the album and record.

13 Claims, 3 Drawing Sheets

DISPLAY CASE FOR PHONOGRAPH ALBUM AND RECORD

BACKGROUND OF THE INVENTION

1. Field of the Invention

This invention relates to the display of phonograph albums and records, and more particularly to a display case for simultaneously displaying both a phonograph album and the record.

2. Description of the Prior Art

Display frames or cases for phonograph album covers, and for records are known and are used to display these items both by commercial music outlets or stores and by record owners. Such display cases or frames make an attractive wall display and are frequently used both as a room decoration and to openly display albums of a particular artist, or collector albums which are difficult to obtain. The known display frames or cases have been designed primarily for the display of the album, per se, although some frames are intended to provide a display and cover for the phonograph record. In either case, it is desirable for the album and/or record be readily accessible for use when desired, and display frames intended to provide access to a record are known. For example, U.S. Pat. No. 5,050,324 discloses a rigid square or rectangular frame structure in which one side of the frame may be displaced, against resilient spring force, to provide access to an album supported in the frame. The moveable frame member guide and supporting elements, and the coil spring retention mechanism are inherently bulky, difficult to operate, and expensive to manufacture.

U.S. Pat. No. 4,536,979 discloses a record jacket frame in which the jacket, or album cover, is installed by deflecting or snapping the corners of the frame beneath retaining clips or guide members and removed by deflecting the corners in the opposite direction. This arrangement is not desirable for particularly decorative albums, or for rare collector albums which may be damaged by repeated bending and snapping of the corners into position.

U.S. Pat. No. 4,499,994 discloses a frame adapted to selectively display either a phonograph album or a phonograph record. This arrangement includes a rigid frame similar to a conventional picture frame with a transparent cover over the front to permit viewing either a record or an album displayed therein. The assembly includes a base or backing member having a recess formed therein for receiving a record which may be viewed when no album or cover is mounted in the frame, and a holding member is provided to retain the record in the recess.

U.S. Pat. No. 4,258,488 discloses an album display frame structure in which the frame defines a relatively deep rectangular recess into which a phonograph album may be placed, in an inclined or tilted position, and detent means is provided on the lower frame portion to support the bottom edge of the album in a position spaced outwardly from the back of the frame structure so that the album rests in the tilted or inclined position. Any jarring or movement of the frame could result in the album tilting outwardly and falling.

Design patent 288,630 discloses a phonograph record display frame in which a record is supported within the frame by a retaining bracket or hanger element which projects through the center opening in the record to removably support the record in a center display position in the frame.

The known phonograph record and album display devices generally have not provided for the simultaneous display of both the album cover and record. Accordingly, it is a primary object of the present invention to provide a display case which enables the simultaneous display of an album and record in a single case.

Another object is to provide a display case which may be easily mounted on a wall surface and which has a closeable, substantially transparent cover for protecting the album and record during display, and which may be easily opened and closed to provide ready access to the record and/or album.

Another object is to provide such an album and record display case in which the record may be displayed in a position partially inserted into the album cover and partially exposed for viewing through a transparent cover.

BRIEF SUMMARY OF THE INVENTION

The foregoing and other objects and advantages are achieved in accordance with the present invention by providing a display case including a base member in the form of a shallow tray and a closable substantially transparent cover member. The base has a substantially rectangular planar bottom wall and integrally formed upwardly extending sidewalls and end walls providing a depth for the tray sufficient to receive a record and album. The transverse width of the tray, within the sidewalls, is substantially equal to but slightly greater than the maximum dimension of a conventional record album or cover and having a length which is at least slightly greater than the outside dimension of a standard album plus one-half the diameter of a standard phonograph record.

The tray cover has a planar transparent top panel having integrally formed short sidewalls extending perpendicular thereto along its longitudinal side edges and an end wall at one end, and fits closely over the base tray. The sidewalls of the base tray each have an integrally formed boss or pivot pin projecting outwardly therefrom adjacent to one end of the base to provide a pivot axis for the tray cover. The sidewalls of the tray cover each have a cylindrical opening extending therethrough adjacent the end opposite said one end, with the openings being dimensioned to receive the pivot pins or bosses. The top panel and sidewalls of the cover are sufficiently resilient to permit deflection outwardly to snap the cover sidewalls over the pivot pins to releasably attach the cover to the base.

The inner surface of the bottom wall of the base member has a mounting post integrally formed thereon and protecting upwardly therefrom at a location midway between the longitudinal sidewalls and spaced from the hinged end of the base a distance about two-thirds of the length of the bottom panel. The mounting post has a height no greater than the height of the base sidewalls, and has a diameter to fit through the central opening in a standard phonograph record to support the record preferably with a portion of the record projecting into an open side edge of an album having its opposite side edge in juxtaposition to the closed end wall of the base at the hinged end thereof.

The end walls of the base and top opposite the hinged end of the case have integrally formed detent means to releasably retain the top in a closed position on the base. Also, the end wall of the top preferably has a cutout in its free edge at a location corresponding to an outwardly extending ledge integrally formed on the corresponding end wall of the base to facilitate manually opening and closing of the display case.

The bottom or external surface of the base panel may have integrally formed thereon a number of short mounting posts dimensioned to project into mating openings on hanging brackets for mounting the display case on a wall. The hanging brackets may be formed of the same material as the base and top, or of a different material, and may be retained on the mounting post by a friction or interference fit, or by an adhesive or otherwise. Preferably the brackets are located to permit the display case to be supported on the wall in a horizontal, vertical, or angled orientation.

By forming the top from a substantially rigid transparent synthetic resin material such as a crystal polystyrene material, a record album and record may be displayed in and readily viewed through the transparent panel of the top member. At the same time, the display case may be readily opened to remove the record and/or album without the necessity of removing the display case from the wall.

BRIEF DESCRIPTION OF THE DRAWINGS

Other features and advantages of the invention will be apparent from the detailed description contained hereinbelow, taken in conjunction with the drawings in which.

DESCRIPTION OF THE PREFERRED EMBODIMENTS

Figure 1:
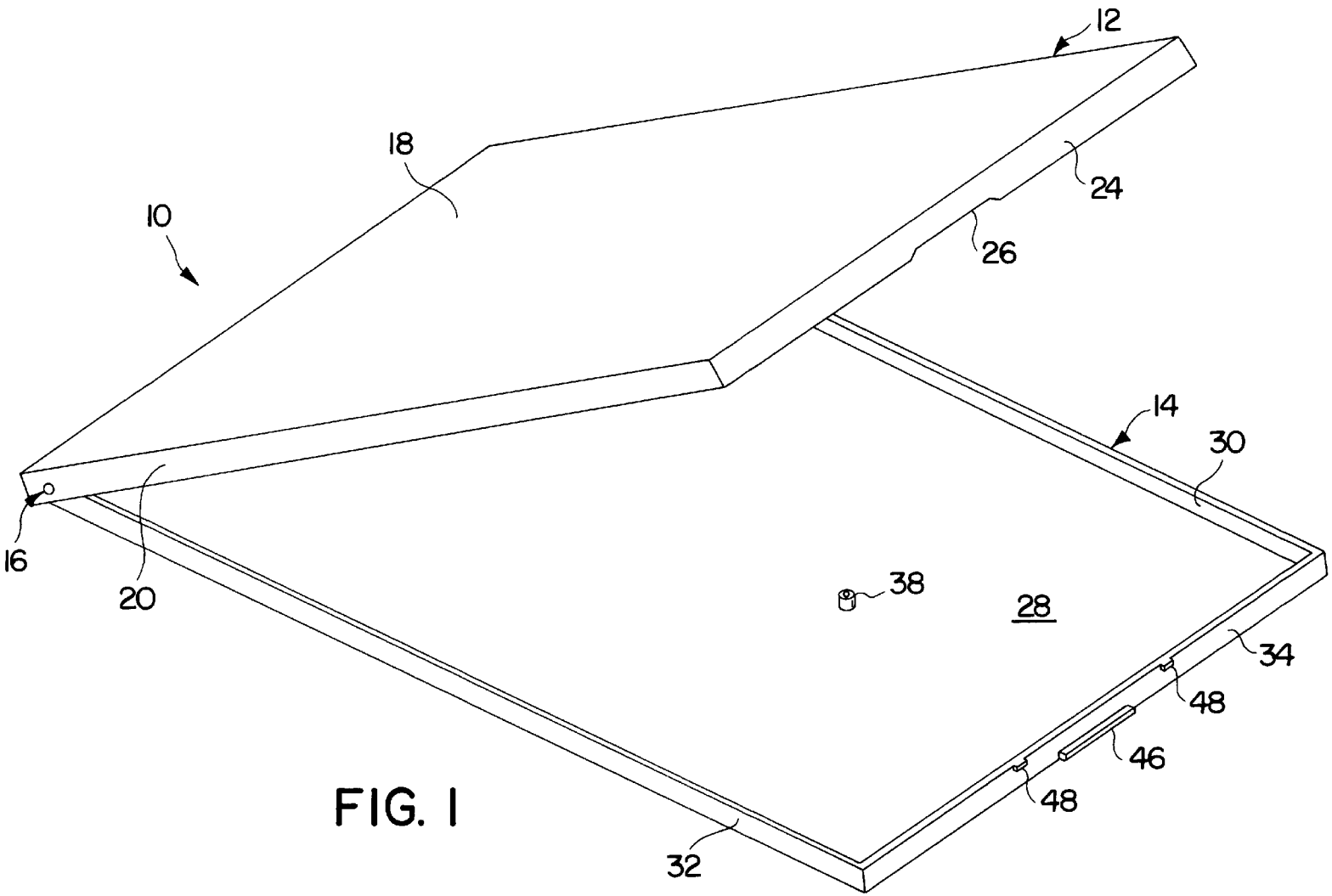
FIG. 1 is an isometric view of the display case of the present invention, with the top shown in a partially opened position.

Referring now to the drawings in detail, a phonograph album and record display case in accordance with the present invention is designated generally by the reference numeral 10 and illustrated in FIG. 1 in a partially opened position. The display case 10 includes a shallow, generally tray like top 12 and a generally flat tray-like bottom 14 with the top and the bottom being hinged together adjacent one end as shown at 16. Top 12 comprises a substantially planar top panel 18 having integrally formed sidewalls 20, 22 extending one along each side edge of the panel, and an end wall 24 extending along one end edge of the panel. A notch 26 is formed at a central location in the end wall 24 to facilitate opening the display case as described more fully hereinbelow. The tray-like top 12 has an open end opposite the end wall 24.

The bottom tray 14 also comprises a substantially plainer base or bottom panel 28 having short sidewalls 30, 32 extending one along each side edge thereof and end walls 34, 36 extending one along each end edge. The bottom and top members 12, 14 are each preferably integrally molded from a single homogeneous mass of substantially rigid, transparent synthetic resin material such as a crystalline polystyrene material although, if desired, the bottom 14 may be formed from a different, substantially rigid material which is translucent or opaque and may be of any desired color, although the bottom should be of a color which will contrast with a phonograph record.

The distance between sidewalls 30, 32 is substantially equal to but slightly greater than the dimension of a standard phonograph album cover. The length of the bottom tray 14, measured between the end walls 34, 36, is greater than its width by a distance at least slightly greater than the radius of a standard phonograph record, but preferably less than the combined dimensions of the album cover and record diameter.

Figure 2:
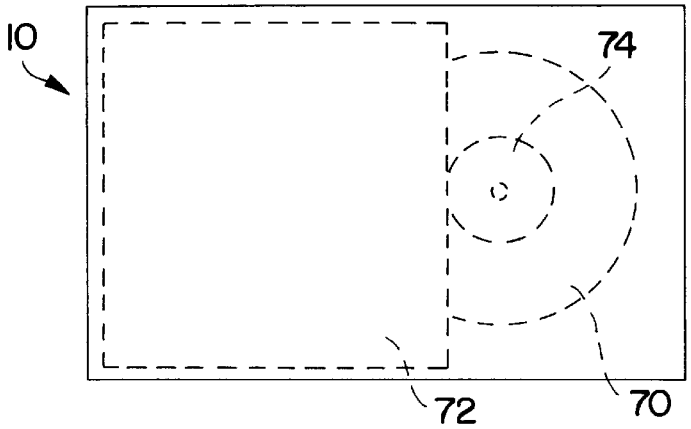
FIG. 2 is a top plan view of the display case shown in FIG. 1.

Integrally molded on the inner surface of the planar panel 28 is a record-mounting post, or pin 38 having an outside diameter dimensioned to fit within the central opening of a phonograph record to position and support a record in the display case. Post 38 is located on the longitudinal center line of the panel 28, i.e., midway between sidewalls 30, 32, and at a distance spaced from end wall 34 a distance substantially equal to one half the distance between sidewalls 30, 32, which distance is slightly greater than but slightly greater than the radius of a standard phonograph record. The height of post 38 is substantially equal to, but preferably slight less than the height of the sidewalls 30, 32 so that, when the top 12 is in the closed position as shown in FIG. 2, the top of the post does not actually contact the inner surface of the top panel 18.

Referring now to FIGS. 9–12, the sidewalls 30, 32 each have a reduced height adjacent the end wall 36, as shown at 40, and end wall 36 has a height less than end wall 34. Also, each sidewall 30, 32 has an integrally molded outwardly projecting boss or hinge pin 42 adjacent the end wall 36 at a location below the notch 40 to be received in a cylindrical opening 44 formed one in each of the top tray sidewalls 20, 22, adjacent the end thereof opposite the end wall 24. Since the opening 44 and hinge pin 42 are spaced slightly inward from the end wall 36, the notched down area 40 permits the top 12 to pivot freely about the pins 42 to open the display case in a manner illustrated in FIG. 1.

Figure 4:
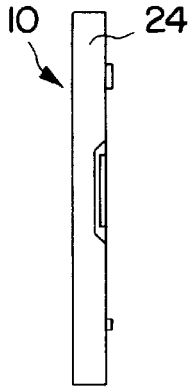
FIG. 4 is an end view of one end of the display case.
Figure 3:
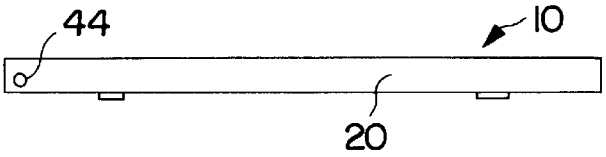
FIG. 3 is a side elevation view of the display case shown in FIG. 1.

End wall 34 has an outwardly projecting ledge 46 adjacent the bottom edge thereof at a location midway between side edges 30, 32 and within the notch or cutout 26 in the end wall 24 when the display case is in the closed condition as shown in FIG. 4. The depth of the cutout 26 is greater than the thickness of the ledge 46 to provide a means for easily opening the display case by manually holding the ledge and lifting the top 12 by applying a pressure to the cutout 26.

Figure 5:
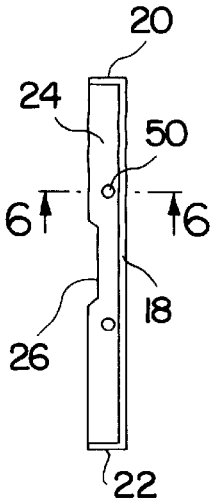
FIG. 5 is an end view of the moveable top of the display case, taken from the end opposite to FIG. 4.
Figure 7:
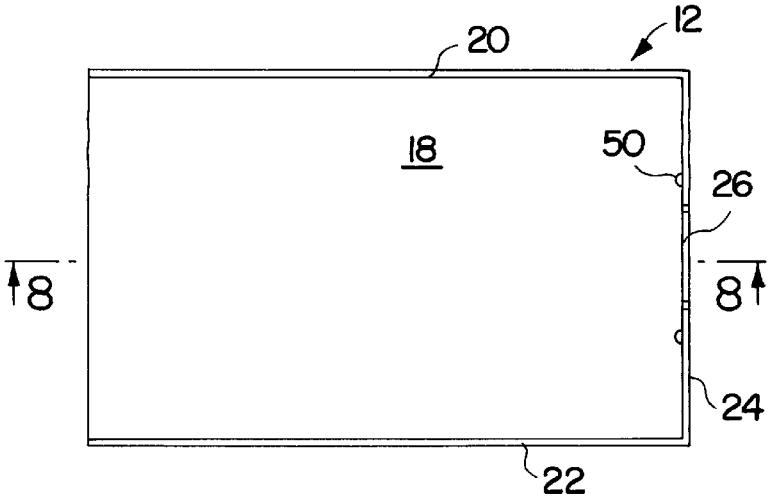
FIG. 7 is a top plan view of the base portion of the display case.
Figure 6:
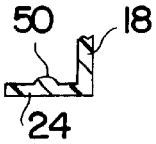
FIG. 6 is an enlarged, fragmentary sectional view taken along lines 6—6 or FIG. 5.
Figure 8:
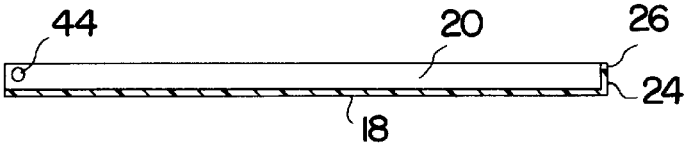
FIG. 8 is a sectional view taken along line 8—8 of FIG. 7.
Figure 9:
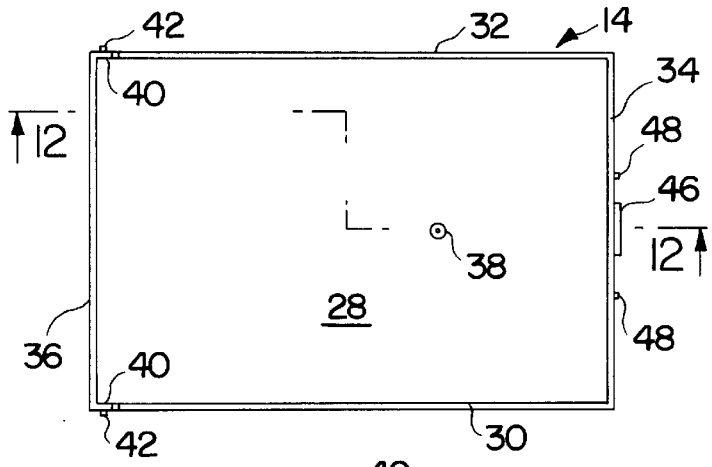
FIG. 9 is a bottom plan view of the base portion of the display case.
Figure 10:
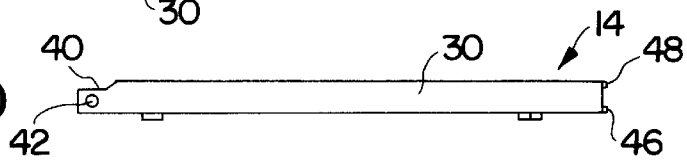
FIG. 10 is a side elevation view of the structure shown in FIG. 9.
Figure 11:
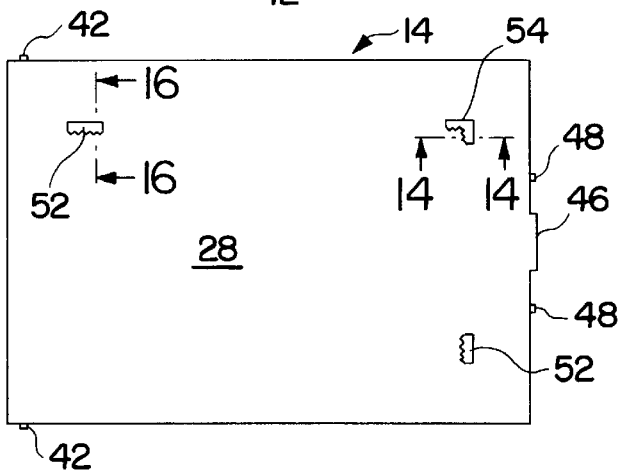
FIG. 11 is a bottom plan view of the structure shown in FIG. 9.
Figure 12:
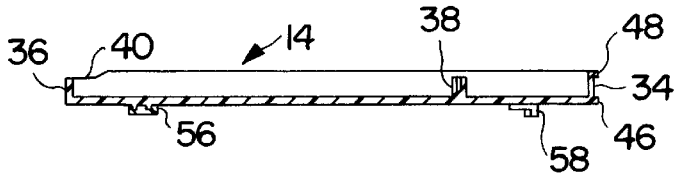
FIG. 12 is a sectional view taken on line 12—12 of FIG. 9.
Figure 13:
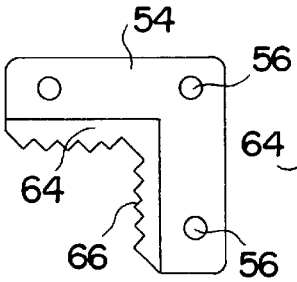
FIG. 13 is an enlarged plan view of an angled hanger bracket used to mount the display case as a wall.
Figure 14:
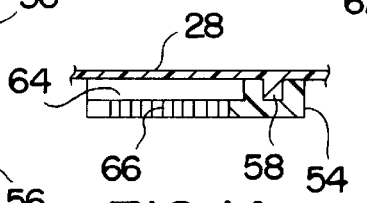
FIG. 14 is an enlarged sectional view taken on line 14—14 of FIG. 11.
Figure 15:
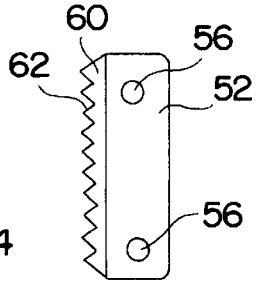
FIG. 15 is an enlarged plan view of another hanger bracket.
Figure 16:
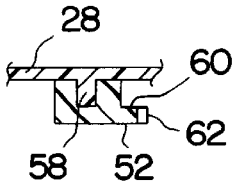
FIG. 16 is an enlarged sectional view taken on line 16—16 of FIG. 11.

End wall 34 also is provided with a pair of outwardly projecting detent or latching tabs 48 adjacent the top or free edge of wall 34 in position to engage and snap beneath a pair of rounded protrusions 50 integrally molded on the inner surface of end wall 24 as most clearly seen in FIGS. 5 and 6. Thus, tabs 48 and protrusions 50 cooperate to form a resilient or releasable detent or latching means for retaining the display case in the closed position.

Referring now to FIGS. 11–16, it is seen that the outer surface of bottom panel 28 is provided with a plurality of wall hanger elements for mounting the display case on a wall or other vertical surface with the longitudinal axis of the display case either in the horizontal, vertical or diagonal orientation. This is accomplished by a pair of identical hanger bars 52 and an angled hanger 54, with one of the hanger bars 52 and the angle hanger 54 being spaced from one another and spaced slightly inwardly from the end wall 34. The second hanger bar 52 is mounted in space relation to end wall 36 and in equally spaced relation to the adjacent sidewall as the angle hanger 54.

Preferably the hangers 52, 54 have cylindrical bores 56 formed in their face surface which abuts the outer surface of panel 28, and panel 28 has integrally formed thereon a plurality of short, cylindrical bosses or mounting pins 58 in position to fit one within each cylindrical opening 56 in the hanger members. The bosses 58 and the cylindrical openings 56 may be a dimension to provide a tight interference fit, or an adhesive may be applied to firmly bond the hangers to the mounting pins. Alternatively, other means such as an adhesive, screws, or the like may be employed to mount hangers directly to the external surface of panel 28.

The hanger bars 52 are formed with a recess extending along the one longitudinal side edge to provide an overhanging ledge 60, and serrations 62 are formed in the edge of the ledge for easily supporting the display case on a suitable fastener such as a tack or the head of a screw or nail. Similarly, the angled mounting member 54 has a cutout forming an overhang or ledge 64 on the inner angled portion thereof and serrations 66 are formed along both legs of the overhang.

As shown in broken lines of FIG. 2, a record 70 and album 72 are displayed within the display case by opening the case and positioning the album or dust cover within the case adjacent end wall 36 with the open side of the album directed toward end wall 34. The record is then partially inserted into the open edge of the album and the central opening in the record is positioned over the record mounting pin 38. The mounting pin 38 is located from the end wall 34 a distance substantially equal to one-half the spacing between sidewalls 30, 32 so that more than one-half and preferably most of the record label 74 is visible through the top transparent panel 18 of the display case.

With the album and record positioned in the tray-like bottom, the top can be closed and by snapping the tabs 48 past the rounded protrusions 50. This releasable detent or latching arrangements permits the display album to be easily opened, without removing it from its hanging position on a wall, by placing a thumb or finger on the ledge 46 to hold the base firmly against the wall, and pulling outward on the end wall 24 at the notch 26.

While the preferred embodiment of the invention has been disclosed and described, it is apparent that modifications might be made thereto and it is therefore intended to include all embodiments thereof which would be apparent to one skilled in the art which come within the spirit and scope of the invention.

What is claimed is:

1. A display case for simultaneously displaying a phonograph album and record, comprising:

a base member in the form of an open topped shallow tray having a generally rectangular, planar bottom panel and upwardly extending sidewalls and end walls, respectively, at its opposed side edges and end edges, a record mounting post on and projecting from the inner surface of the bottom panel for mounting a phonograph record on the bottom panel adjacent one said end wall, the mounting post being dimensioned to project through the central opening in the record to locate the record in the display case, said shallow tray being dimensioned to receive an album for display therein between said sidewalls and between said mounting post and the other said end wall when one edge of the album is positioned in juxtaposition to the other said end wall, said mounting post being in substantially equally spaced relation to each of said sidewalls and from said one end wall of said base member a distance at least equal to the radius and less than the diameter of a record to be displayed and spaced from said other end wall a distance at least equal to the distance between said sidewalls and less than the combined album edge length and record diameter, a cover member pivotally mounted on said base member for movement between an open and a closed position, the cover member including a rectangular generally planar, transparent cover panel dimensioned to overlay and cover said base member open top, sidewalls extending one along the opposed side edges of said cover panel in overlapping relation to the sidewalls on said base member when the cover member is in the closed position, and releasable latching means for releasably retaining the cover member in the closed position.

2. The display case defined in claim 1 wherein said mounting post has a height above said inner surface of said bottom panel substantially equal to but no greater than the maximum height of said sidewalls.

3. The display case defined in claim 2 wherein said cover member further comprises an end wall extending in overlying relation to said one end wall of said base member when the cover member is in the closed position, and wherein said releasable latching means comprises cooperating detent means carried by said end wall of said cover member and said one end wall of said base member.

4. The display case defined in claim 3 wherein said pivot means comprises a pair of axially aligned laterally extending pin members carried one on each sidewall of said base member or said cover member, and a pair of openings formed one in each of the sidewalls of the other of said base member or said cover members adjacent the end thereof opposite said one end of said base member, said pin members being received in said openings for free rotation therein.

5. The display case defined in claim 4 further comprising hanger means mounted on the outer surface of said bottom panel for mounting the display case on a wall.

6. The display case defined in claim 5 wherein said cover member is formed of a generally rigid transparent synthetic resin material.

7. The display case defined in claim 5 wherein said cover member and said base member are each formed of a generally rigid transparent synthetic resin material.

8. The display case defined in claim 2 wherein said cover member further comprises an end wall extending in overlying relation to said one end wall of said base member when the cover member is in the closed position, and wherein said releasable latching means comprises cooperating detent means carried by said end wall of said cover member and said one end wall of said base member.

9. The display case defined in claim 1 further comprising hanger means mounted on the outer surface of said bottom panel for mounting the display case on a wall.

10. The display case defined in claim 1 wherein said cover member is formed of a generally rigid transparent synthetic resin material.

11. The display case defined in claim 1 wherein said cover member and said base member are each formed of a generally rigid transparent synthetic resin material.

12. A display case for simultaneously displaying both a phonograph record and its album, comprising:

a base member in the form of a shallow open topped tray having a generally rectangular bottom panel and upwardly extending sidewalls and end walls at its peripheral edges, said bottom panel having a width between said sidewalls to receive a phonograph album therebetween with opposed edges of the album parallel to the sidewalls and having a length between said end walls greater than the combined length of the edge of an album and the radius of a phonograph record to be displayed therein but less than the combined album edge length and record diameter, a record mounting post carried by and projecting from said bottom panel between and substantially equally spaced from said sidewalls and being dimensioned to be received in the central opening of a phonograph record, said mounting post being spaced from one of said end walls a distance at least equal to the distance between said sidewalls but less than the combined length of the album edge and the record diameter and spaced from the other said end wall a distance greater than the record radius but less than the record diameter, and a cover member including a generally planar rectangular transparent cover panel having a pair of sidewalls extending one along the opposed side edges of the cover panel and an end wall extending along one end edge of the cover panel, hinge mean pivotally mounting said cover member on said base member at a location adjacent said one end wall of said base member, and cooperating latching means between said cover member and said base member at the ends thereof opposite said hinge means for releasably retaining the cover in a closed position on said base member with the transparent panel overlying and covering the open top of said base member.

13. The display case defined in claim 12 wherein said pivot means comprises a pair of axially aligned laterally extending pin members carried one on each sidewall of one of said base member or said cover member, and a pair of openings formed one in each of the sidewalls of the other of said base member or said cover member adjacent the ends thereof opposite said one end of said base member, said pin members being received in said openings for free rotation therein.

* * * * *